United States Patent [19]

Ramsey

[11] Patent Number: 4,679,875

[45] Date of Patent: Jul. 14, 1987

[54] ATTACHMENT OF ELECTRIC CABLE TO SUBMERGIBLE PUMP MOTOR HEADS

[75] Inventor: Wayne H. Ramsey, Bartlesville, Okla.

[73] Assignee: TRW Inc., Cleveland, Ohio

[21] Appl. No.: 806,487

[22] Filed: Dec. 9, 1985

[51] Int. Cl.[4] ..... H01R 11/00

[52] U.S. Cl. ..... 439/604; 439/276

[58] Field of Search ..... 339/59 R, 59 M, 60 R, 339/60 M, 94 R, 94 M

[56] References Cited

U.S. PATENT DOCUMENTS

| | | | |
|---|---|---|---|
| 2,283,117 | 5/1942 | Arutunoff | 103/87 |
| 2,944,297 | 7/1960 | Maynard | 18/59 |
| 3,043,903 | 7/1962 | Keane et al. | 174/152 |
| 3,248,582 | 4/1966 | Brown | 310/87 |
| 3,293,463 | 12/1966 | Church | 310/71 |
| 3,308,316 | 3/1967 | Pfahl | 310/87 |
| 3,457,866 | 7/1969 | Komor | 103/87 |
| 3,716,309 | 2/1973 | Mitchell | 417/422 |
| 3,830,955 | 8/1974 | Double | 174/65 |
| 4,029,382 | 6/1977 | Koda | 339/94 |
| 4,053,196 | 10/1977 | Dunaway | 339/94 |
| 4,128,735 | 12/1978 | Zehren | 174/65 |
| 4,312,553 | 1/1982 | Lyckesjö | 339/60 |
| 4,500,151 | 2/1985 | Ayers | 339/59 R |
| 4,583,804 | 4/1986 | Thompson | 339/60 M |
| 4,626,721 | 12/1986 | Ouchi | 339/94 R |

*Primary Examiner*—Gil Weidenfeld
*Assistant Examiner*—Paula A. Austin
*Attorney, Agent, or Firm*—Shapiro and Shapiro

[57] ABSTRACT

The end of an electric cable for energizing the motor of a submergible pump is attached to a motor head by a device comprising a rigid shell having a body of elastomeric material filling an end portion of the shell and projecting therefrom to form an insert. Conductors of the cable extend through the elastomeric material and have terminals that engage corresponding terminals within the motor housing. The body of elastomeric material is sealed in the shell, and the conductors are sealed in the body. The remainder of the shell is filled with strain relief material. The insert is tapered and has circumferential flexible ridges that engage and seal upon the cylindrical wall of a bore leading into the motor head. An integral circumferential bead on the body seals against the end of the shell and against a portion of the motor head surrounding an end of the bore.

15 Claims, 5 Drawing Figures

ATTACHMENT OF ELECTRIC CABLE TO SUBMERGIBLE PUMP MOTOR HEADS

BACKGROUND OF THE INVENTION

This invention is concerned with the attachment of an electric cable to the motor of a submergible pump and is more particularly concerned with improved attachment devices or "potheads", as they are known in the art.

A state-of-the-art pothead employed commercially by the assignee of the present invention comprises a rigid metal shell (termed a "flange") containing a block of rubber through which the conductors of an electric cable extend, the ends of the conductors having terminals that engage corresponding terminals of the motor conductors. The rubber block is compressed between relatively rigid washers at opposite ends of the block. The washers and the rubber block are sealed to the inner surface of the flange, and the conductors are sealed within the washers and the block. The washer closest to the terminals is surrounded by a cylindrical gland packing, the packing being inserted in a recess formed by the external surface of the washer and the internal surface of the flange. A lead gasket is pressed into a small gap between a circumferential portion of the gland and an opposed portion of the flange. The gland projects from an end of the flange to engage the cylindrical wall of a lead-in bore of the motor head. An O-ring surrounds the gland and is compressed between an end of the flange and a portion of the motor head surrounding an end opening of the bore. The internal space in the shell beyond the other washer is filled with a strain relief material, such as epoxy resin.

In an earlier form of pothead employed by the assignee of the present invention, a cable-entry portion of the flange is filled with an elastomeric material and an adjacent cable-exit portion of the flange contains an aluminum block. The cable conductors extend through and are sealed into the elastomeric material and the aluminum block. A cylindrical gland surrounds an end portion of the aluminum block and fits between the block and the internal wall of the flange. An end of the gland and an end of the block are received between the end of the gland and a shoulder on the motor head.

Other forms of potheads are disclosed in Zehren U.S. Pat. No. 4,128,735 and in Arutunoff U.S. Pat. No. 2,283,117, both assigned to the assignee of the present invention.

BRIEF DESCRIPTION OF THE INVENTION

A principal object of the present invention is to provide potheads that are more economical and reliable than comparable potheads of the prior art. In general, potheads in accordance with the invention have fewer parts and are easier to manufacture and use. O-rings, lead gaskets, precision machined parts, close tolerances, and special tools to compress rubber blocks are not required. The potheads of the invention are simple, yet rugged, and accommodate temperature changes better than potheads of the prior art having rubber parts trapped between metal pieces.

Briefly stated, in a preferred embodiment of the invention a device for attaching the end of an electric cable to a motor head or the like having an opening for receiving the device comprises a rigid shell with a body of elastomeric material filling an end portion of the shell and projecting therefrom to form an insert to be received in said opening, said cable having conductor means extending through said body and provided with terminal means projecting from said insert, said body being sealed within said shell and said conductor means being sealed within said body, said insert having an integral external peripheral bead abutting an end of said shell and having external peripheral ridge means for sealing said insert in said opening with said bead against a portion of said motor head surrounding said opening and with said terminal means extending into said opening.

BRIEF DESCRIPTION OF THE DRAWINGS

The invention will be further described in conjunction with the accompanying drawings, which illustrate preferred (best mode) embodiments, and wherein.

DETAILED DESCRIPTION OF THE INVENTION

The general arrangement of a pothead assembled with a motor head of a submergible pump unit is well known in the art and is described, for example, in Arutunoff U.S. Pat. No. 2,283,117 cited earlier and incorporated herein by reference. The following description will therefore be directed to the details of the improvement provided by the present invention.

Figure 2:
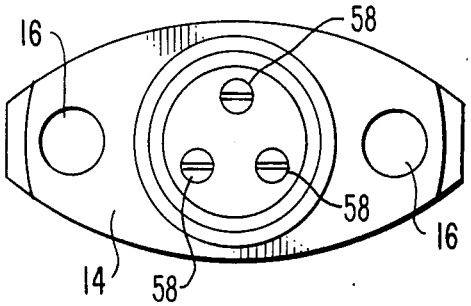
FIG. 2 is an end view of the pothead of FIG. 1 as seen from below prior to assembly with the motor head.
Figure 1:
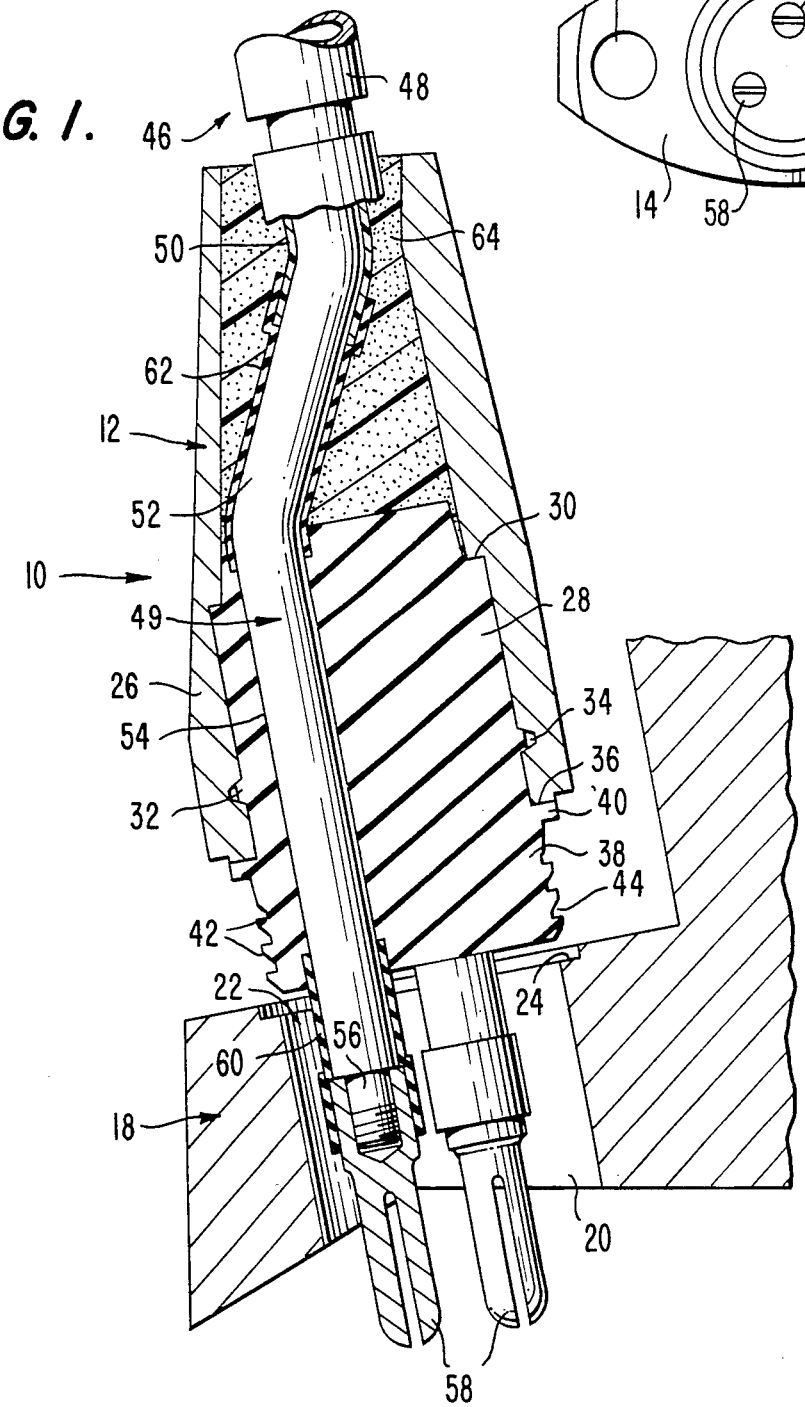
FIG. 1 is a longitudinal sectional view illustrating a pothead of the invention about to be attached to a motor head.

As shown in FIG. 1, a pothead 10 in accordance with the invention comprises an elongated rigid metal shell 12 termed a "flange", because as shown in FIG. 2 the bottom end of the shell has a transverse flange 14 (extending perpendicular to the plane of the drawing of FIG. 1) with holes 16 through which bolts extend downwardly into corresponding threaded bores in the motor head for securing the pothead to the motor head. The motor head 18 in FIG. 1 has a cylindrical (straight-walled) lead-in bore 20 with an external opening 22 surrounded by a shoulder 24. An end portion 26 of the shell 12 is filled with a body 28 of elastomeric material, such as rubber. The rubber body fits snugly within the shell, engaging the inner cylindrical wall of the shell as well as a circumferential internal shoulder 30. To enhance the sealing of the rubber body within the shell and to assist in retaining the body within the shell, the body has an integral circumferential ridge 32 that fits within an internal circumferential groove 34 formed on the inner wall of the shell.

A portion of the rubber body 28 projects from an end 36 of the shell to form an insert 38. The portion of the rubber body within the shell is generally cylindrical, but the insert is frusto-conical, i.e., tapered so that its cross dimensions become smaller away from the end 36 of the shell. The insert has an external peripheral bead 40 that abuts end 36 of the shell and has a plurality of external peripheral flexible ridges 42 that are substantially V-shaped in cross section and that are separated from one another by circumferential grooves 44 of substantially the same cross section.

The usual electric cable employed in the invention is an armored cable 46 having a plurality of insulated conductors 49. To assemble the cable with the pothead, the armor 48 near the end of the cable is unwrapped or otherwise removed for a specified distance, usually for about 8 inches. The protective jacket 50 over the conductor insulation 52 is removed also, but over a slightly shorter distance.

The insulated conductors 49 are then pushed through the shell 12 until they project well beyond the end 36. The rubber body 28, which are this time is positioned outside of end 36 of the shell, has longitudinal bores 54 for receiving the respective conductors of the cable, and the conductors are forced through the bores so that their ends project from the insert 38. At least a portion of the bores that is ultimately inside the shell 12 is preferably tapered so that the cross dimensions decrease away from the end 36 of the shell. The exposed projecting ends 56 of the conductors are provided with conventional terminals 58. Insulating tape or tubing, of Teflon, for example, is installed over portions of the conductor insulation at opposite ends of the rubber body 28, as shown at 60 and 62, in order to protect the insulation from well fluid and fluid inside the motor and in order to assist in keeping the insulation on the conductors in place.

Then the assembly of the cable and the rubber body 28 is forced backwardly into the shell 12 so that the ridge 32 snaps into the groove 34 and the bead 40 abuts the end 36 of the shell as shown in FIG. 1. This compresses the rubber body 28 around the conductors 49 to seal the rubber body in the shell and to seal the conductors in the rubber body. The sealing of the conductors in the rubber body is assisted by the tapered shape of the bores 54. In addition, a suitable bonding agent, such as an adhesive, may be applied between the rubber body and the shell and between the conductors and the rubber body. To complete the pothead, the remainder of the space within the shell 12 is filled with a suitable strain relief material, such as a high temperature potting resin, epoxy, or molten lead 64. When this material becomes hard, it acts as a support for the rubber body and the armor on the cable and holds the conductors 49 in place.

Figure 3:
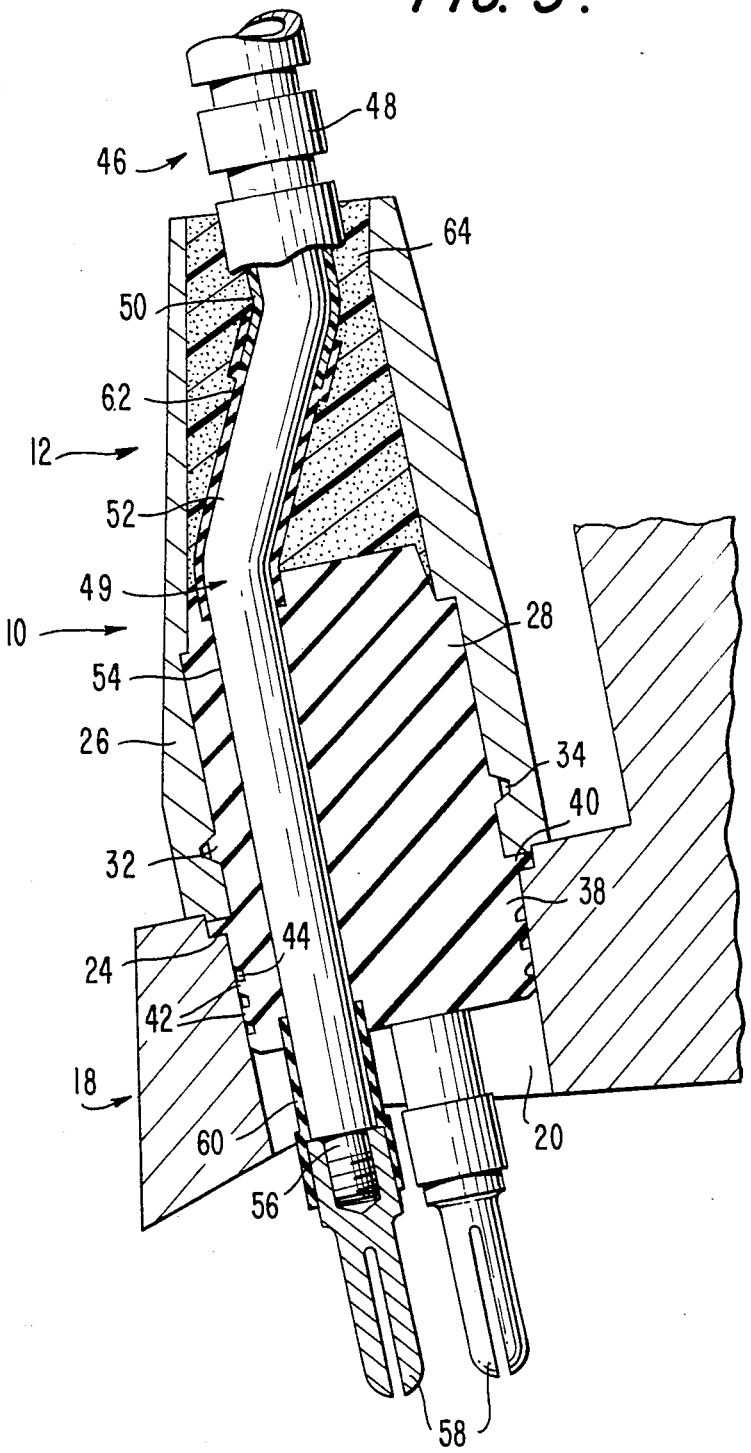
FIG. 3 is a view similar to FIG. 1, but with the pothead shown attached to the motor head.

To assemble the pothead 10 with the motor head 18, the projecting terminals 58 and the insert 38 are forced into the motor head to the position shown in FIG. 3. The ridges 42 on the tapered insert become compressed against the cylindrical side wall of the bore 20, flexing rearwardly during the insertion procedure, and seal against the side wall of the bore. The bead 40 is squeezed against the shoulder 24 and forms a gasket compressed between the shoulder and the end 36 of the shell 12, compressive force being applied by the bolts that attach the flange 14 of the shell to the motor head 18.

The pothead of the invention is simple, rugged, easily constructed and assembled with a motor head, and provides excellent sealing. A single elastomeric body 28 is employed without compression washers, and the strain relief material is applied directly against the elastomeric body. This greatly simplifies construction. A separate O-ring to seal the motor head to the pothead flange is not required. Instead, the preferred form of the invention employs three types of integral seals, (1) the ridges 42 on the tapered insert 38, (2) the bead or gasket 40, and (3) the ridge 32. Sealing of the conductors in the elastomeric body 28 is provided by the compression of the tapered bores 54 around the conductors 49 and by the bonding agent in the bores.

The invention eliminates precision machined parts employed heretofore and avoids the strict tolerances that have been required. Smooth surfaces previously needed for O-rings are no longer required, and special tools that have been necessary for the compression of rubber blocks are no longer needed. A further advantage is that temperature changes are more easily accommodated, because the elastomeric body 28 is not trapped between rigid washers.

Figure 4:
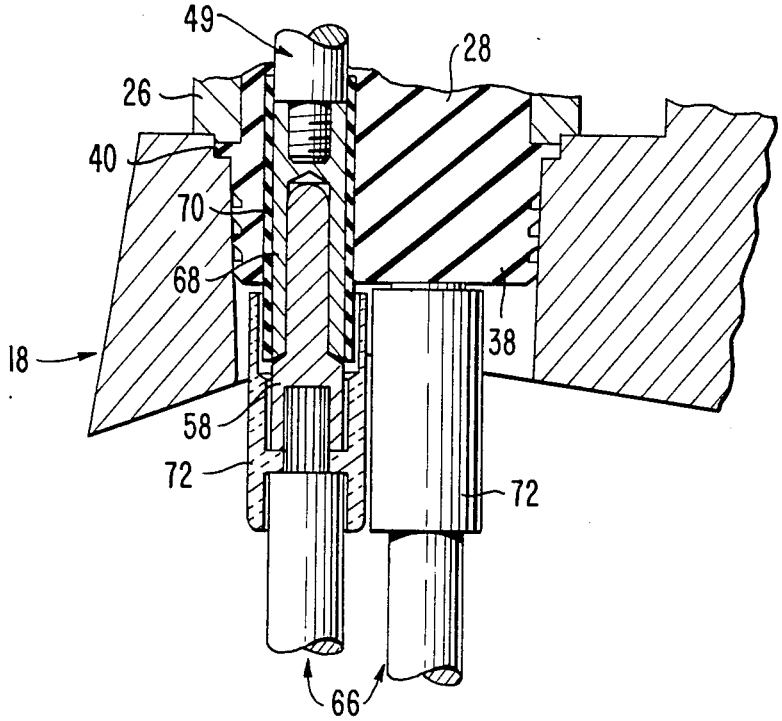
FIGS. 4 and 5 are fragmentary longitudinal sectional views illustrating modifications of the invention.
Figure 5:
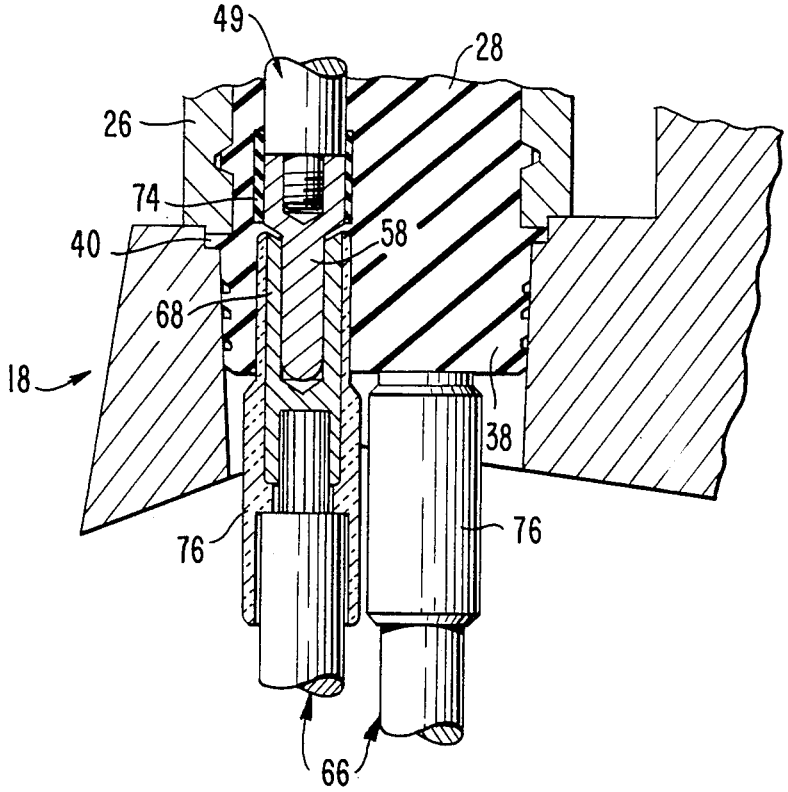

FIGS. 4 and 5 show the conductors 49 of the cable connected to corresponding conductors 66 of the motor in two modifications of the invention. In FIG. 4 the male terminals 58 are attached to the motor conductors 66. Female terminals 68 are attached to the conductors 49. In FIG. 5 the arrangement of the terminals is reversed, with the male terminals 58 attached to conductors 49 and the female terminals 68 attached to the conductors 66. In both FIGS. 4 and 5 the mating terminals are at least partially within the body 28, so that the compressive forces applied to the insert 38 provide better electrical contact between the mating terminals. In FIG. 4 the mating terminals are surrounded by additional insulating sleeves 70 and 72, while in FIG. 5 sleeves 74 and 76 surround the mating terminals.

The elastomeric body 28 may be molded about the ends of the conductors 49 so as to be integral therewith. Indeed, the elastomeric body may be molded into the shell 12 so as to become integral therewith. Both techniques may be employed to improve the sealing.

While preferred embodiments of the invention have been shown and described, it will be apparent to those skilled in the art that changes can be made in these embodiments without departing from the principles and spirit of the invention, the scope of which is defined in the appended claims.

The invention claimed is:

1. A device for attaching an end of an electric cable to the head of a motor or the like having an opening for receiving the device, said device comprising a rigid shell with a body of elastomeric material filling an end portion of the shell and projecting therefrom to form an insert to be received in said opening, said cable having conductor means extending through said body and provided with terminal means at an end of said conductor means, said body being sealed within said shell and said conductor means being sealed within said body, said insert having an integral external peripheral bead abutting an end of said shell and having external peripheral ridge means for sealing said insert in said opening with said bead against a portion of said motor head surrounding said opening and with said terminal means positioned to engage cooperable terminal means of the motor head via said opening.

2. A device in accordance with claim 1, wherein said body has an integral external peripheral ridge received in an internal peripheral groove of said shell.

3. A device in accordance with claim 1, wherein said conductor means comprises conductors extending through bores in said body of elastomeric material, the cross dimensions of said bores becoming smaller as said bores extend inwardly of said shell.

4. A device in accordance with claim 1, wherein said body of elastomeric material is molded onto said conductor means.

5. A device in accordance with claim 1, further comprising strain relief means filling a portion of said shell adjacent to said body of elastomeric material and surrounding said conductor means.

6. A device in accordance with claim 5, wherein said strain relief means comprises a material molded into said shell and engaging an end of said body of elastomeric material.

7. A device in accordance with claim 1, wherein said insert is tapered and has cross dimensions that become smaller as the insert projects away from said shell.

8. A device in accordance with claim 7, wherein said ridge means comprises a series of flexible ridges.

9. Apparatus comprising a motor head having an entry bore with an opening to the exterior of the motor head and having motor head terminal means, and a device for attaching an end of an electric cable to the motor head, said device comprising a rigid shell having a body of elastomeric material filling an end portion of the shell and projecting therefrom to form an insert, said body being sealed within said shell, said cable having electric conductor means extending through said body and sealed therein and provided with terminal means at an end of said conductor means, said insert having an integral external peripheral bead engaging an end of said shell and having integral external peripheral flexible ridge means, said insert being tapered, with smaller cross dimensions away from said shell, said bore in said motor head being straight-walled, said insert extending into said bore with the ridge means compressed by the bore and with the bead engaging a portion of said motor head extending about said opening, whereby said body of elastomeric material is sealed to said motor head, said motor head terminal means being engaged with the terminal means of said electric conductor means.

10. Apparatus in accordance with claim 9, wherein said body has an integral external peripheral ridge received in an internal peripheral groove of said shell.

11. Apparatus in accordance with claim 9, hwerein said ridge means comprises a series of ridges.

12. Apparatus in accordance with claim 9, wherein said conductor means comprises conductors extending through bores in said body of elastromeric material, the cross dimensions of said bores becoming smaller as said bores extend inwardly of said shell.

13. Apparatus in accordance with claim 9, wherein said body of elastomeric material is molded onto said conductor means.

14. Apparatus in accordance with claim 9, further comprising strain relief means filling a portion of said shell adjacent to said body of elastomeric material and surrounding said conductor means.

15. Apparatus in accordance with claim 14, wherein said strain relief means comprises a material molded into said shell and engaging an end of said body of elastomeric material.

* * * * *